United States Patent [19]

Schmitt

[11] Patent Number: 5,012,713

[45] Date of Patent: May 7, 1991

[54] DIE POWER PACK FOR CUTTING APPARATUS

[75] Inventor: Thomas E. Schmitt, Randolph, Ill.

[73] Assignee: Progressive Service Die Company, St. Louis, Mo.

[21] Appl. No.: 451,926

[22] Filed: Dec. 18, 1989

[51] Int. Cl.[5] ..... B26D 5/12

[52] U.S. Cl. ..... 83/639.3; 83/513; 83/519; 83/568; 83/639.1; 83/639.5; 83/694; 83/914

[58] Field of Search ..... 83/620, 622, 639.1, 83/639.3, 639.5, 687, 688, 690, 691, 694, 914, 821, 513, 519, 568

[56] References Cited

U.S. PATENT DOCUMENTS

| | | | |
|---|---|---|---|
| 2,970,505 | 2/1961 | Geenen | 83/639.5 X |
| 3,172,327 | 3/1965 | Hazzard | 83/690 |
| 3,227,026 | 1/1966 | Werntz | 83/688 X |
| 3,472,109 | 10/1969 | Haas et al. | 83/639.1 X |
| 3,786,709 | 1/1974 | Spengler | 83/339 |
| 3,800,641 | 4/1974 | Spengler | 83/50 |
| 3,813,978 | 6/1974 | Spengler | 83/401 |
| 3,859,879 | 1/1975 | Spengler | 83/155 |
| 4,014,234 | 3/1977 | Spengler | 83/162 |
| 4,041,847 | 8/1977 | Spengler | 83/561 X |
| 4,100,844 | 7/1978 | Spengler . | |
| 4,106,379 | 8/1978 | Spengler | 83/171 |
| 4,273,738 | 6/1981 | Spengler | 83/17 X |
| 4,277,996 | 7/1981 | Spengler | 83/171 |
| 4,286,490 | 9/1981 | Spengler | 83/453 |
| 4,328,067 | 5/1982 | Cesano | 83/514 X |
| 4,405,537 | 9/1983 | Spengler | 264/45.4 |
| 4,471,679 | 9/1984 | Spengler | 83/529 |
| 4,491,046 | 1/1985 | Hosogaya | 83/589 |
| 4,508,499 | 4/1985 | Spengler | 425/88 |
| 4,519,766 | 5/1985 | Spengler | 425/302.1 |
| 4,634,483 | 1/1987 | Spengler | 156/216 |
| 4,785,695 | 11/1988 | Riley | 83/49 |

*Primary Examiner*—Frank T. Yost
*Assistant Examiner*—Eugenia A. Jones
*Attorney, Agent, or Firm*—Paul M. Denk

[57] ABSTRACT

Apparatus (1) for cutting a three-dimensionally shaped work-piece (C). The work-piece is placed in a mold (3) shaped to conform to the final shape of the work-piece. A first stationary frame assembly (11) holds the mold. A second frame assembly (31) is positioned above the first frame assembly and is vertically movable a short dimension with respect to it. A hoist (51) raises and lowers the second frame assembly. A plurality of cutting implements (81) carried by the second frame assembly cut the work-piece. The cutting implements are operable to cut the work-piece when the second frame assembly is lower to a position immediately above the first frame assembly.

8 Claims, 3 Drawing Sheets

DIE POWER PACK FOR CUTTING APPARATUS

BACKGROUND OF THE INVENTION

This invention relates to the forming and cutting of three-dimensional work-pieces, incorporating inherent contours, and more particularly, to apparatus for performing such operations.

In the manufacture of certain types of three-dimensional items, for example, carpeting for use in automobiles and door interior side panels, also for use in automobiles, the item, or work-piece, is placed in a mold. The mold is mounted in a frame of some type which is moved into position adjacent a series of arranged cutting knives. The knives are arranged to make both cuts around the perimeter of the work-plate in addition to performing interior cuts so that the work-piece becomes a completed item after the cutting operation performed by the knives is finished. The use of a movable mold in which a work-piece is arranged, the use of knife positioning, and knife movement are all known in the art. See, for example, the U.S. patents to Spangler; as documented in some of the U.S. Pat. Nos. 4,634,483, 4,519,766, 4,508,499, 4,471,679, 4,405,537, 4,286,490, 4,277,996, 4,273,738, 4,106,379, 4,100,844, 4,041,847, 4,014,847, 3,859,879, 3,813,978, 3,800,641, and 3,786,709, as well as U.S. Pat. No. 4,785,695, to Riley, U.S. Pat. No. 4,328,067 to Cesano, and U.S. Pat. No. 3,172,327 to Hazzard.

Manufacturing equipment employing the teachings of various of these patents is in use; however, the equipment has been found to have certain drawbacks. Among these are its cost, its size, its complexity, and its difficulty in usage. What would be advantageous is equipment which performs the cutting operations required to produce a finished item from a work-piece that is compact, relatively simple in design and construction, easy to use, requiring less manipulations, and being lesser expensive than the overly complex machinery currently available.

SUMMARY OF THE INVENTION

Among the several objects and advantages of the present invention may be noted the provision of an apparatus for forming and cutting items such as carpeting for automobiles and the like, from shaped work-pieces placed in a mold.

Another object of this invention is the construction of an apparatus for cutting such type molded items from three-dimensionally arranged work-pieces, all in a single cutting operation.

Still another object of this invention is the provision of such an apparatus to make simultaneously both cuts around the perimeter and periphery of a work-piece, while additionally severing interior cuts from the work piece so as to form an item having a complex three-dimensional shape, cut specifically both externally and internally to precise dimensions, so that it can be readily installed within an item, such as an automobile, during its assembly.

Still another object of this invention is the providing of such a die power pack for a cutting apparatus that functions and operates knives, conveniently aligned, as used in the cutting process, for either furnishing simultaneous or sequential cuts within the material when finally preparing a finished work-piece.

Yet another object of this invention is the furnishing of an apparatus which accommodates a plurality of knives, within die power packs, or rendered operative therefrom, as arranged in different combinations, orientations, and angulations, with respect to the work piece to be cut.

Still another object of this invention is the furnishing of an apparatus which is simple in design and construction, safe and easy to use, and relatively inexpensive, mainly because of the assembly of die power packs, holding their specific knives, at particular locations within the apparatus as assembled.

Yet another object of this invention is to provide a cutting apparatus, wherein the mold supporting the work-piece to be cut is maintained stationary, and the upper cutting apparatus may be maintained in proximity with the mold, raised only sufficiently to provide clearance for insertion of the work-piece therein, in preparation for its cutting, with a slight lowering of the cutting apparatus only required to bring it into proximity with the work-piece in preparation for its multi-die cutting.

Briefly stated, the apparatus of the present invention is for cutting a three-dimensionally shaped work-piece to form a completed item. The work-piece is received in, or upon, a mold having a shape conforming to the final shape of the work-piece. A first frame assembly, generally maintained stationary, holds the mold. A second frame assembly is positioned above the first frame assembly and is vertically movable for a slight distance, in either direction to be raised and lowered relative to the first frame assembly. A plurality of cutting implements are carried on the second frame assembly to cut the work-piece. These implements are operable to cut the work-piece when the second frame assembly is lowered to a position immediately above the first frame assembly. Generally these cutting implements are pneumatically operated to project knives a select depth to achieve the required design cuts. Other objects and features will be in part apparent and in part pointed out hereinafter, following a review of the description of the preferred embodiment, in view of the drawings.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
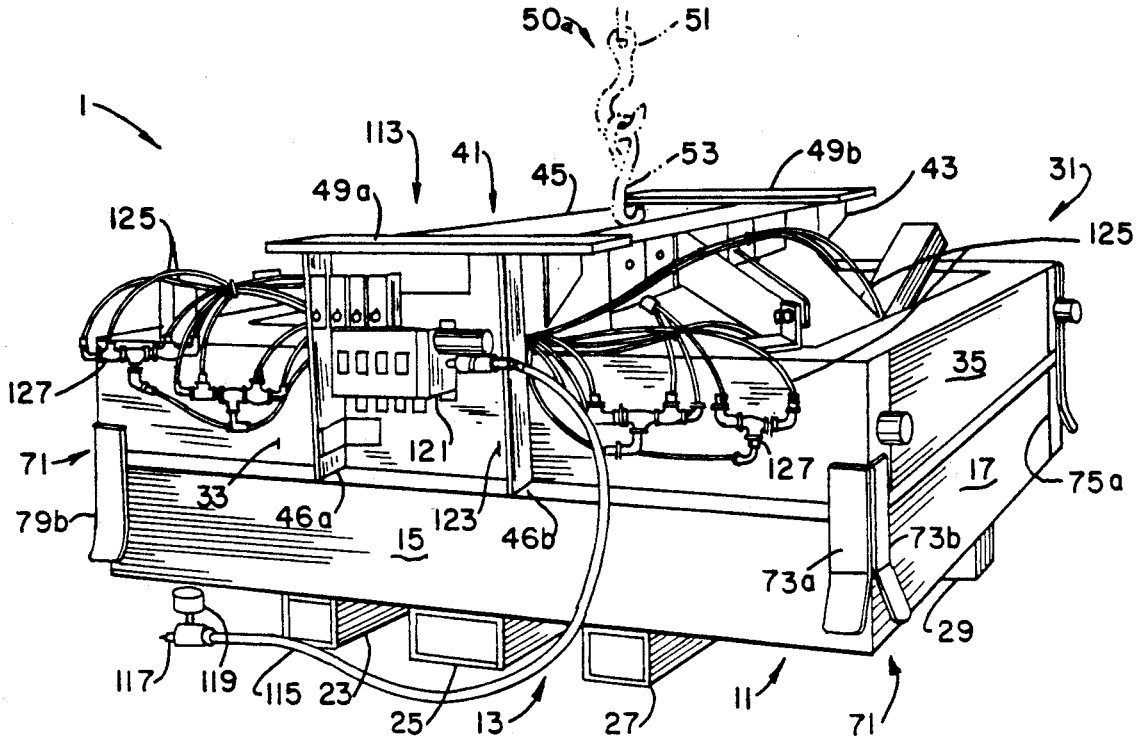
FIG. 1 is an isometric view of the apparatus of the present invention.
Figure 2:
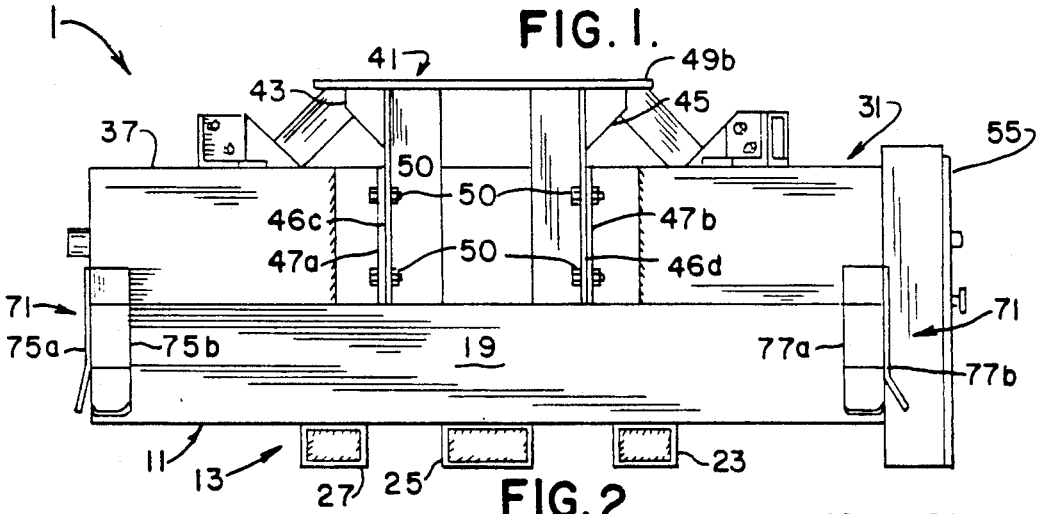
FIG. 2 is a side elevational view of one side of the apparatus.
Figure 3:
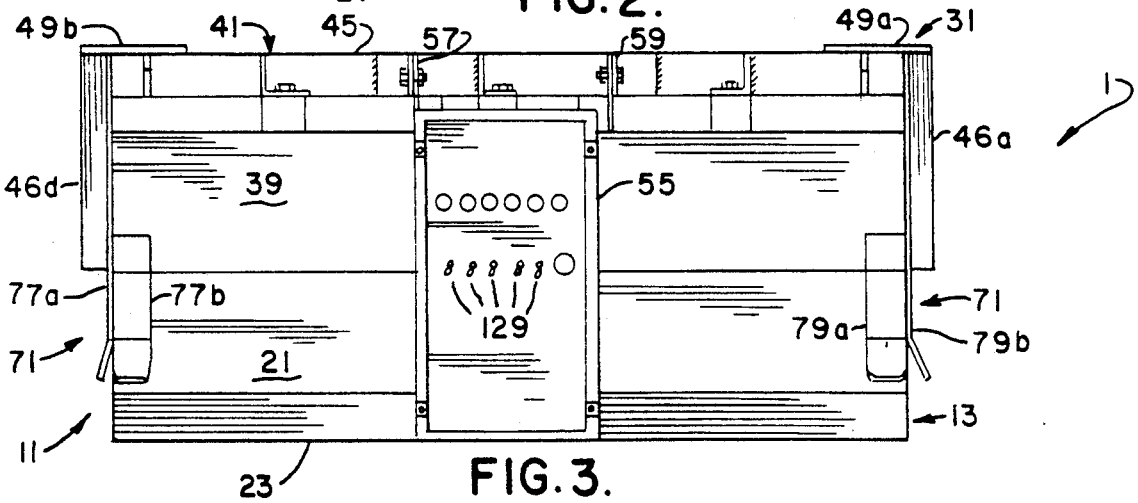
FIG. 3 is a side elevational view of the opposite side of the apparatus.
Figure 5:
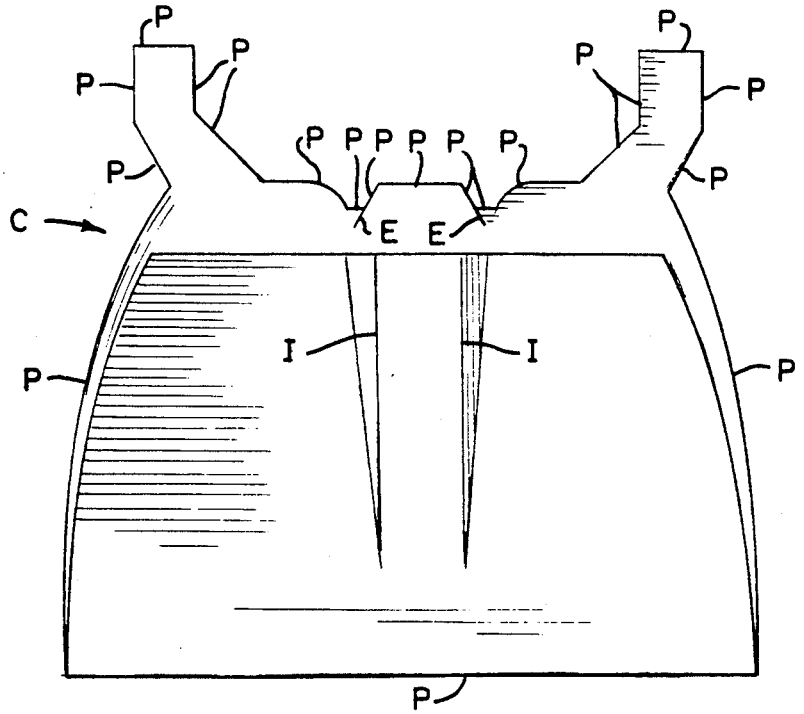
FIG. 5 is a plan view of a completed item made using the apparatus of the present invention.

Referring to the drawings, and particularly FIGS. 1 through 3, an apparatus for cutting a three-dimensionally shaped work-piece, is shown generally at 1. The work-piece may be one of many different types of pieces; for example, a carpet C as shown in FIGS. 5 may be used for installation in an automobile as part of the flooring for the vehicle. It will be understood that the finished item formed from the work-piece has to conform to a particular size and shape, and apparatus 1 is designed to produce such a completed item which so conforms. While the following description of the construction and operation of apparatus 1 is with respect to the manufacturing of an automobile carpet, the apparatus is readily adaptable to cutting out different types of pieces for a variety of applications without significant modification.

Figure 4:
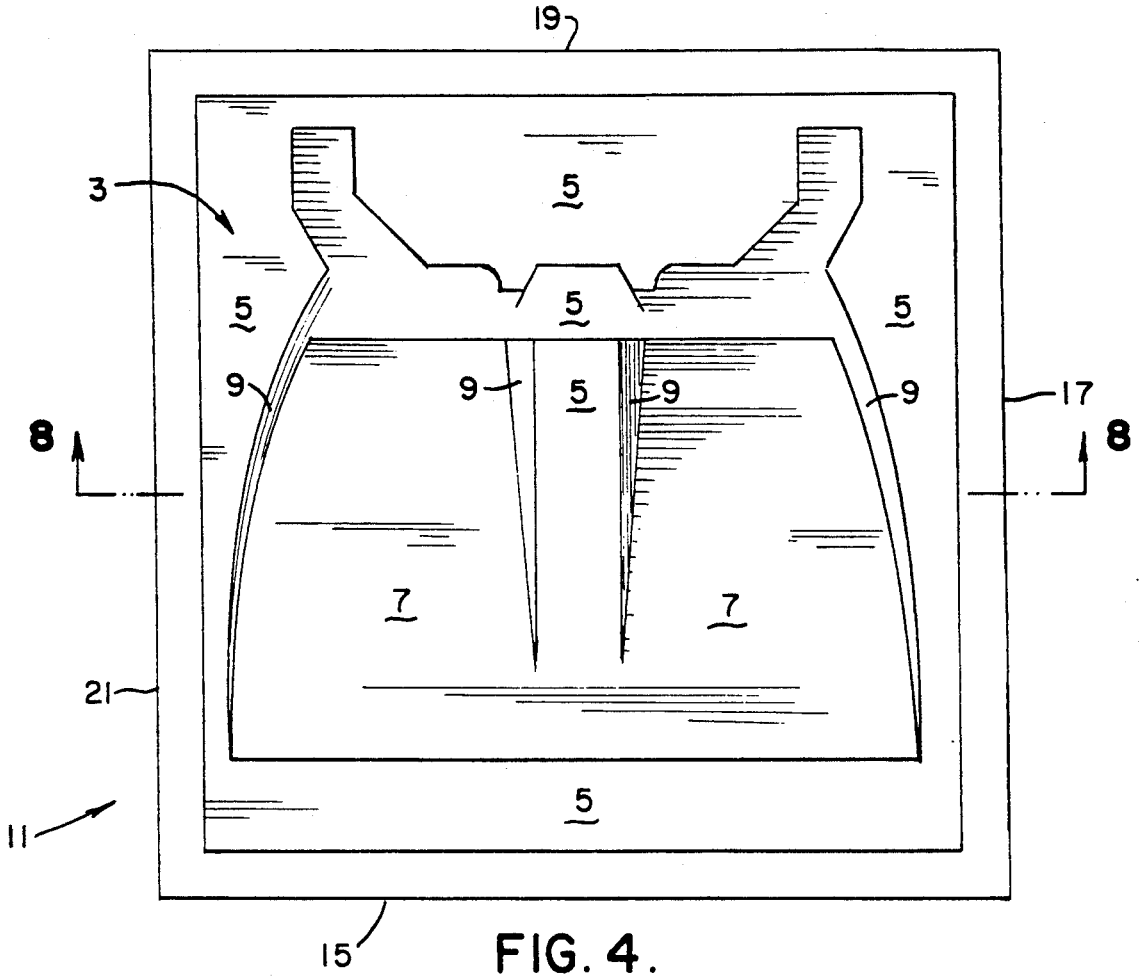
FIG. 4 is a plan view of the mold upon which a work-piece is located for cutting an item.
Figure 8:
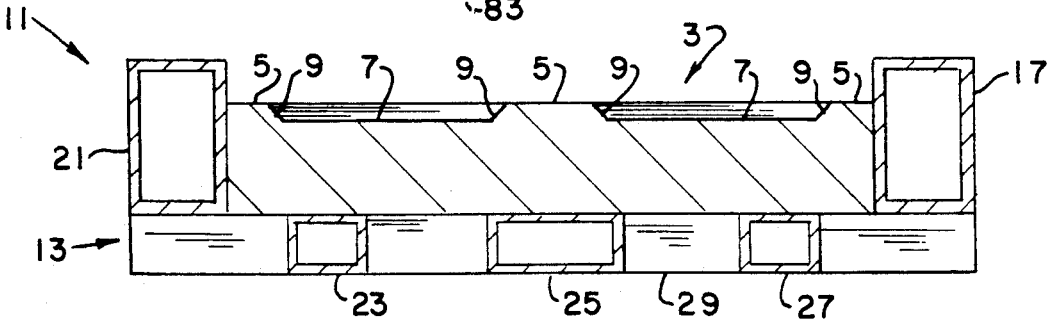
FIG. 8 is a sectional view of the apparatus, taken along line 8—8 in FIG. 4, of the lower frame assembly.

Apparatus 1 first includes a mold 3. As shown in FIGS. 4 and 8, the mold is a three dimensionally shaped mold designed to receive a work-piece to be cut or formed into a finished item such as the carpet C shown in FIG. 5. The mold is formed so to have a three-dimensional shape conforming to the final shape of the work-piece. Thus, the mold has appropriate raised sections 5, scooped or depressed sections 7, and intermediate or transitional sections 9. Consequently, when a work-piece is set onto the mold, it assumes the shape of the completed item to be cut out by the apparatus.

Next, the apparatus includes a first frame means or frame assembly 11 for holding the mold. The lower frame assembly also comprises a support base 13 for the apparatus. The frame assembly has four side members 15, 17, 19 and 21 forming a rectangular frame. The perimeter of mold 3 is attached to the respective inner walls of these members, in any suitable manner, to secure the mold in place. The side members are, for example, constructed of an array of beams having rectangular cross-sections, as shown in FIG. 8.

The support base for the apparatus has three longitudinally extending beams 23, 25 and 27, and a cross beam 29. These beams are also rectangular in cross-section, as shown in FIGS. 1, 2, and 8, with beam 25 being wider than beams 23 and 27, for greater structural strength, beam 25 extends longitudinally beneath the longitudinal center line of the apparatus. Beams 23 and 27 are equidistantly spaced apart from beam 25, on either side of the beam, and extend longitudinally of the apparatus parallel to beam 25. Beam 29 extends crosswise beneath assembly 11 at the mid-point of the assembly.

In addition to the lower frame assembly, the apparatus has a second frame means or upper frame assembly 31. Assembly 31 is positioned above assembly 11 and is vertically movable with respect to it. The assembly is rectangular in plan and is formed of side members 33, 35, 37 and 39 which are connected at their respective ends, and a support 41 attached to the top of the assembly and extending lengthwise of it. Support 41 is comprised of a pair of spaced apart, parallel beam members 43 and 45. The support is mounted above the side members and is secured to the side members by vertical support braces 46*a* and 46*b* located at one end of the assembly, and similar braces 46*c* and 46*d* located at the other end of the assembly. At the end of the assembly shown in FIG. 2, it can be seen that vertical brackets 47*a* and 47*b* respectively abut braces 46*c* and 46*d* to strengthen the structure of support 41. The brackets and their associated braces are bolted together by fasteners 50. Respective attachment plates 49*a* and 49*b* extend crosswise of support 41, at each end of the support and the upper end of the braces are attached to these plates.

A hook means 50*a* is connected to beam 41 for a hoist 51 to attach to upper frame assembly 31 to raise and lower it, or perhaps, a form of hydraulic ram (not shown) may be used for automating this maneuver. Means 50 includes a latch plate 52 extending between beam members 43 and 45 (see FIG. 6). Hoist 51 includes a hook 53 which hooks around or latches onto plate 52. The hoist is controlled by an operator from a control panel 55 located on one side of the apparatus (see FIG. 3). Alternatively, the hoist can be remotely controlled. In either, event, the hoist or ram is used to raise and lower the vertically movable upper frame assembly 31 with respect to the stationary lower frame assembly 11.

Upper frame assembly 31 also includes a pair of cross beams 57 and 59, extending between respective side members 35 and 39. Beams 57 and 59 run parallel to each other and are equidistantly spaced from a point representing the mid-point of the apparatus. Each beam has two sections. Beam sections 57*a* and 59*a* extend from side member 39 of the upper frame assembly to beam member 45, while corresponding beam sections 57*b* and 59*b* extend from beam member 43 to side member 35. The beam sections are attached to the respective side members by L-shaped brackets 61 and by nuts and bolts, 63 and 65 respectively. Alternatively, the beam sections may be welded. Assembly 31 further includes diagonal beam members 67 and 69 respectively extending across each of its diagonals.

As previously described, the apparatus has a hoist 51 for raising and lowering the upper frame assembly. The apparatus further has means 71 for guiding these movements. Means 71 includes a guide plate assembly 73, 75, 77 and 79, attached to the outer face of the respective side members comprising the upper frame assembly at the corners of the apparatus. Each assembly includes a pair of guide plates (73*a*, 73*b*; 75*a*, 75*b*; 77*a*, 77*b*; 79*a*, 79*b*). Each guide plate projects downwardly below the side members of the upper frame assembly to contact the upper end of the lower frame assembly, as the upper frame assembly is lowered thereon. As shown in FIGS. 1 through 3, each pair of guide plates are positioned at the corners of their associated side members so the plates comprising each pair are at right angles to each other. In addition, the lower portion of each guide plate flares outwardly. This allows the plates to align and then guide movement of the upper frame assembly once the guide plates contact the upper end of the lower frame assembly.

Figure 6:
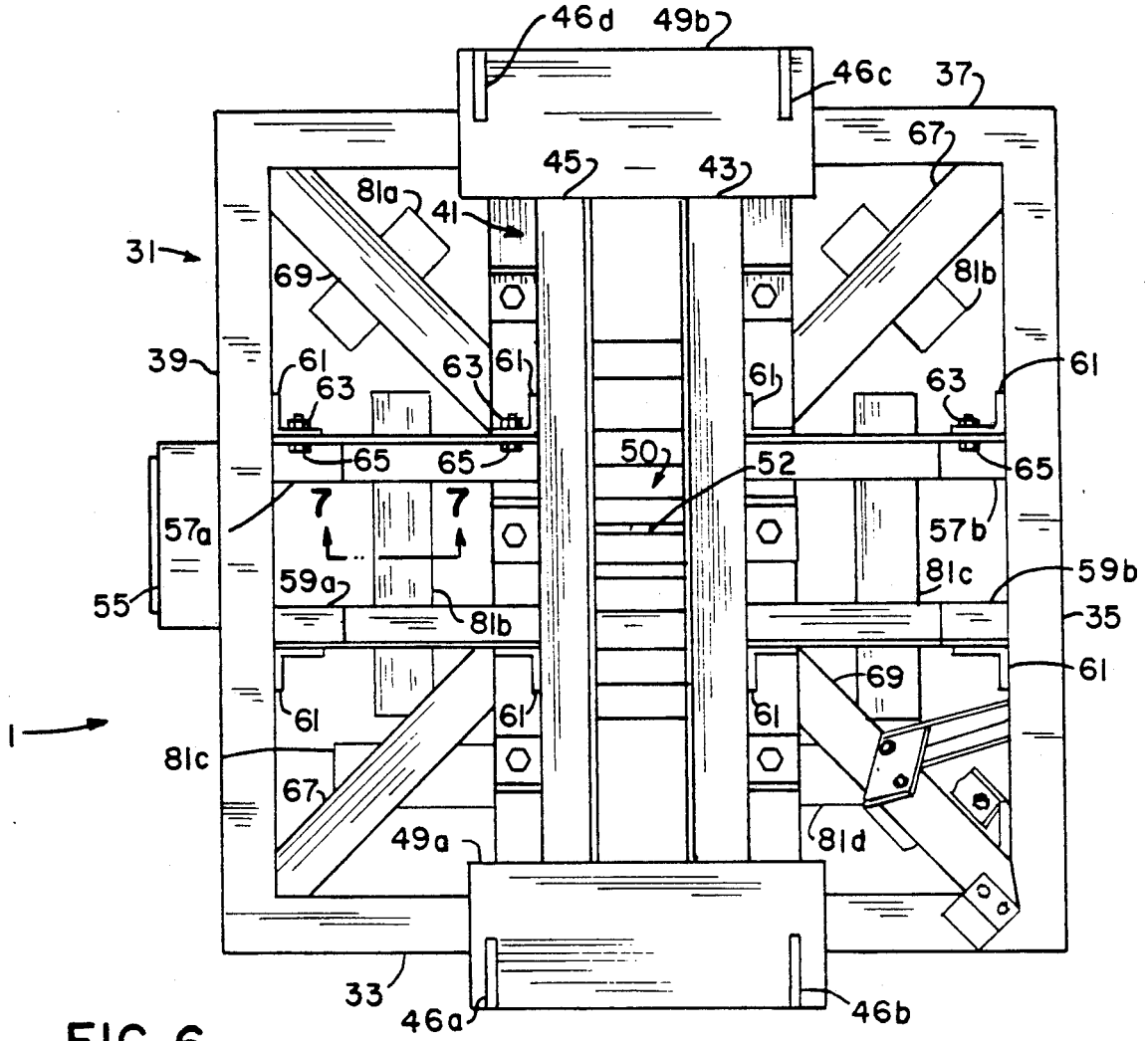
FIG. 6 is a top plan view of the upper frame assembly of the apparatus.

A plurality of cutting means 81 are carried by upper frame assembly 31 for cutting a work-piece. Six of these cutting means or implements (81*a*–81*f*) are shown in FIG. 6. The implements are operable to cut a work-piece when upper frame assembly 31 is lowered on top of lower frame assembly 11. The cuts can be either peripheral cuts around the sides of the work-piece, cuts extending from the periphery of the work-piece into its interior, or interior cuts, such as slits or openings. Referring to FIG. 5, the carpet C is seen to be cut-out using primarily peripheral cuts P. However, the carpet may also require cuts E extending from the periphery of the work-piece into its interior, and interior cuts I; it being understood that the particular cuts indicated in FIG. 5 are illustrative only.

The cutting implements are mounted on the various cross beams, diagonal beams and side members of the upper frame assembly as appropriate. They are also variable as to their orientation and angulation with respect to the shape of the mold mounted in the lower frame assembly. It will be understood that there may be more or fewer than the six cutting implements shown in FIG. 6, the exact number of implements employed and their configuration depending upon the work-piece to be cut. In addition, the implement may be aligned continuously, for furnishing a complete exterior cutout of the work-piece, such as carpeting, from an over all pre-shaped sheet of the same.

Figure 7:
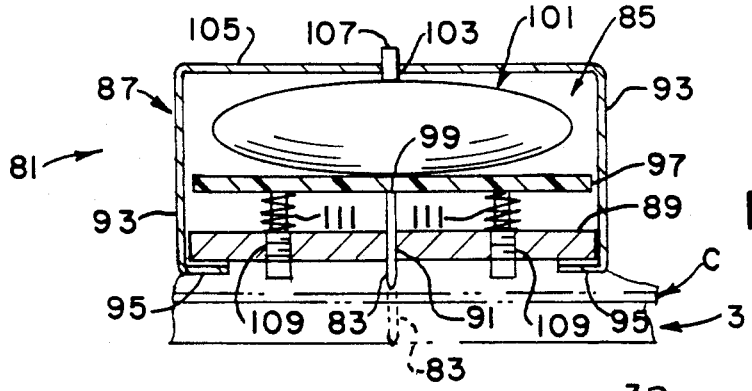
FIG. 7 is a sectional view, taken along line 7—7 in FIG. 6, of a cutting implement used on the apparatus to cut the work-piece.

Each implement includes a knife 83, means 85 for moving the knife from a first and retracted position (the solid line position in FIG. 7) to a second and extended position (the dashed line portion as shown in FIG. 7), and a housing 87 in which means 85 is enclosed. Housing 87 is attachable to the various beams and side members comprising the upper frame assembly to properly orient the knife to the mold and the work-piece. The knife used in a particular cutting unit has a length dependent upon the length of cut required in that particular area of the mold. The knife is received through a holder 89 which is, for example, a block of phenolic material whose length generally corresponds to the length of the knife. The holder has a longitudinal slot 91 through which the knife extends. The bottom of side walls 93 of housing 87 are inwardly turned to form a flange 95 on each side of the housing and extending its length. The outer side margins on the bottom of holder 89 rest on these flanges.

A plate 97 whose length and width correspond to that of holder 89 is positioned for sliding movement within house 87 above the holder. Plate 97 is thinner than holder 89 and the plate bears against the upper, flattened end 99 of the knife. The plate is installed in housing 87 above the block for the underside of the plate to bear against the upper end of the knife. An inflatable bladder 101 is installed in the upper portion of the housing. Housing 87 has an opening 103 in its top 105 and the bladder has a nipple 107 protruding through this opening. The bladder is formed of a suitable expandable material, such as rubber or polymer, and extends substantially the length of the housing so to exert a uniform force on the upper surface of plate 97 when inflated. Block 89 has a series of holes 109 equidistantly spaced on each side of the longitudinal center line of the block and extending the length of the block. Spring-loaded screws 111 are installed in these holes with the upper, spring portion of each screw contacting the underside of plate 97. When bladder 101 is inflated, plate 97 is pushed downwardly and forces knife 83 through the work-piece positioned on mold 3, to achieve its cutting. When the bladder is deflated, the spring-loaded screws restore the plate in its original position, upwardly within the housing, and serve to retract the knife.

Referring again to FIG. 1, the apparatus includes a pneumatic system 113 for inflating and deflating the various bladders. An air pressure inlet line 115 has an inlet fitting 117 with an associated pressure regulator 119. The inlet line is connected to a pressure manifold 121. The manifold is mounted on a plate 123 extending between braces **46*a*, 46*b*. The manifold has a plurality of outlet fittings (not shown) extending through the backside of plate 123. Pressure hoses 125 have one end connected to these fittings. A number of such hoses are shown in FIG. 1, but only some are identified for sake of drawing clarity. The other end of the hoses are either directly connected to the nipples 107 of bladders 101; or, they are routed to valves 127**. Where numerous cutting implements are utilized, the valves help distribute the pressurized air from the manifold. Again, only some of the valves are indicated for sake of drawing clarity.

The bladders for moving the knives can be inflated either in a sequentially, or simultaneously, to completely cut out a work-piece. Control panel 55 on the side of the apparatus incorporates various controls 129 for operating manifold 121. Depending upon the type of cutting operation desired, the manifold and the various valves are operable in a preselected sequence to operate one cutting unit 81 before another. Alternatively, the manifold and valves are operable to inflate all the bladders at the same time.

In operation, upper frame assembly 31 is initially in an elevated position above lower frame assembly 11. A worker sets a work-piece on top of mold 3 and properly positions it. Once the work-piece is in place, the hoist lowers the upper frame assembly. The guide plates guide the upper frame assembly so it is accurately positioned when it reaches its lowest point adjacent to or resting on top of the lower frame assembly. The bladders in the various cutting units are then inflated; this being done in either a simultaneous or sequential manner Inflating the bladders causes the knives in the units to cut through their respective portion of the work-piece and then retract as their associated bladder is deflated. Once the cutting operating is completed, the upper frame assembly is raised The worker now removes both the completed item and the peripheral scrap pieces from the mold and places and orients a new work-piece on the mold.

Variations or modifications to the subject matter of this invention may be considered by those skilled in the art upon review of this invention, but such variations or modifications, if within the spirit of this invention, are intended to be encompassed within the scope of any claims to patent protection issuing upon this development. The description of the preferred embodiment set forth herein, as shown in the drawings, is provided for illustrative purposes only.

Having thus described the invention, what is claimed and desired to be secured by Letters Patent is:

1. An apparatus for cutting a three-dimensionally shaped work-piece comprising:

a mold in which the work-piece is receivable, the mold having a shape conforming to the final shape of the work-piece;

first frame means for holding the mol second frame means positioned above the first frame means and vertically movable with respect thereto;

means for raising and lowering the second frame means relative to the first frame means;

a plurality of pre-positioned cutting means carried by the second frame means for cutting the work-piece, said cutting means being operable to cut the work-piece when the second frame means is lowered a short distance to a position immediately above the first frame means;

each cutting means comprising a knife and means for moving the knife from a first and retracted position to a second and extended position, the knife cutting the work-piece as it is moved to its extended position, each moving means being attached to the second frame means, the moving means being attached to the second frame means such that when all the moving means have moved their associated knife to its extended position, the knives have completely cut-out the work-piece, each knife being contacted by a plate, and the moving means including an inflatable bladder pushing against the plate, when the bladder is inflated, for the plate to move the knife into a cutting position;

said first frame means comprises a generally rectangular lower frame assembly formed of side members connected at their respective ends, and the mold comprises a three-dimensional mold the perimeter of which is secured to an inner wall of the side members to mount the mold within the lower frame assembly, the second frame means comprises a generally rectangular upper frame assembly formed of side members having ends and with their respective ends being connected, and a beam attached to the top of the upper frame assembly and extending lengthwise of the upper frame assembly, the upper frame assembly including a pair of cross beams extending between respective side members of the upper frame assembly parallel to each other, said cross beams being orthogonal to a longitudinal axis of the apparatus and equidistantly spaced on each side of a mid-point of the upper frame assembly, the upper frame assembly further including diagonal beam members extending across each diagonal of the assembly;

each knife being mounted in a housing, the respective housings being permanently suspended from the cross beams and the beam members in an orientation and angulation such as to permit the knives to cut out the work-piece when the cutting means are operated;

means for guiding the movement of the upper frame assembly, said guiding means including a guide plate assembly attached exteriorly of the side members at each corner of the apparatus, each guide plate assembly projecting downwardly below the side members of the upper frame assembly to contact the lower frame assembly as the upper frame assembly is lowered thereon, each guide plate assembly including a pair of guide plates positioned at respective corners of the upper frame assembly, each guide plate comprising one guide plate of each pair thereof being secured to the respective end of a side member so as to disposed each pair of guide plate at right angles to each other, each guide plate flaring outwardly so as to guide the upper frame assembly onto the lower frame assembly when the guide plates contact the lower frame assembly;

each cutting means including said inflatable bladder and said apparatus further including pneumatic means mounted on the upper frame assembly for selectively inflating the bladder of each cutting means, the pneumatic means including a pressure source attached to one of the side members, a pressure hose extending from the source to the bladder of each cutting means, and a control means for pressurizing each of the bladders during operating of the cutting means, each cutting means further including a block having a longitudinal slot therein through which the knife is received to hold and guide the knife during its cutting, and said plate contacting the knife being positioned between the bladder and the block, and each cutting means further including spring means interposed between the plate contacting the knife and the block to retract the knife after a cutting operation.

2. The apparatus of claim 1 and further including means for sequentially inflating the bladders of the cutting means so as to completely cut out the work-piece when all the bladders have been inflated.

3. The apparatus of claim 1 further including means for simultaneously inflating the bladders of the cutting means so as to completely cut out the work-piece at one time.

4. The apparatus of claim 1 wherein the means for raising and lowering the second frame means includes hook means connected to the beam attached to the top of the upper frame assembly for attachment of a hoist to the upper frame assembly to raise and lower the upper frame assembly.

5. The apparatus of claim 4 wherein the beam attached to the top of the upper frame assembly includes a pair of spaced apart, parallel beam members.

6. The apparatus of claim 5 wherein the hook means includes a latch plate extending between the beam members of the beam attached to the top of the upper frame assembly.

7. The apparatus of claim 4 wherein the control means includes means for controlling the operation of the hoist.

8. The apparatus of claim 1 wherein the first frame means further includes a support base beneath the lower frame assembly.

* * * * *

UNITED STATES PATENT AND TRADEMARK OFFICE

CERTIFICATE OF CORRECTION

PATENT NO. : 5,012,713

DATED : May 7, 1991

INVENTOR(S) : Thomas E. Schmitt

It is certified that error appears in the above—identified patent and that said Letters Patent is hereby corrected as shown below:

Claim 1, column 7, line 45, change "disposed" to ---dispose---.

Claim 1, column 7, line 46, change "plate" to ---plates---.

Signed and Sealed this

Eighth Day of September, 1992

*Attest:*

DOUGLAS B. COMER

*Attesting Officer*

*Acting Commissioner of Patents and Trademarks*